United States Patent [19]

Hill et al.

[11] 4,413,571

[45] Nov. 8, 1983

[54] SOLID FUEL HOT WATER HEATER

[75] Inventors: Richard C. Hill; Mark R. Daniele, both of Orono, Me.

[73] Assignee: The Board of Trustees of the University of Maine, Bangor, Me.

[21] Appl. No.: 278,355

[22] Filed: Jun. 29, 1981

[51] Int. Cl.[3] ..... F23G 5/00; F22B 5/02

[52] U.S. Cl. ..... 110/234; 122/15; 237/19; 110/118; 126/112

[58] Field of Search ..... 110/234, 116, 118; 126/101, 68, 7, 10, 107, 112; 237/19, 50, 8 R; 122/15

[56] References Cited

U.S. PATENT DOCUMENTS 2,327,339 8/1943 Chandler ..... 237/8 R

FOREIGN PATENT DOCUMENTS 563594 5/1922 France ..... 110/234

*Primary Examiner*—Albert J. Makay
*Assistant Examiner*—Henry Bennett
*Attorney, Agent, or Firm*—Daniel H. Kane, Jr.

[57] ABSTRACT

A solid fuel burning hot water heater is described having a primary combustion chamber with a refractory material base portion which forms the locus of combustion. A water jacket defines an upright portion over the refractory base portion for receiving a charge of fuel in a generally vertical stack. The water jacket is coupled to a source of water for at least convection circulation and assists in confining the locus of solid fuel combustion to the base of the chamber. Heat exchange channels or pathways are defined around the outer periphery of the water jacket in heat exchange relationship with the water jacket for transfer of heat from the end products of combustion to the circulating water. A flue gas delay channel arrangement extends from the draft outlet at the base of the combustion chamber to the heat exchange pathways. The delay channel pathways provide delayed propagation of gaseous products of primary combustion in a high temperature refractory environment sufficient to afford substantially complete secondary burning. In the preferred configuration the flue gas delay channel provides pathways coaxially around the walls of the refractory base portion of the primary combustion chamber while the heat exchange pathways are formed coaxially around the water jacket. An opening is formed between the flue gas delay channel pathways and the heat exchange channel pathways. The refractory base portion walls of the primary combustion chamber may be formed in a "U" shaped or arcuate configuration.

20 Claims, 8 Drawing Figures

SOLID FUEL HOT WATER HEATER

FIELD OF THE INVENTION

This invention relates to a new and improved solid fuel hot water heater in a compact configuration suitable for domestic use. The invention is particularly applicable for wood fired hot water heaters with output in the range of for example 10,000 to 20,000 BTU's per hour. The compact geometry contemplated by the invention permits use of the hot water heater at locations otherwise inaccessible to wood fired heating.

BACKGROUND OF THE INVENTION

In U.S. Pat. No. 4,309,965 there is described a new wood fuel combustion system developed by Professor Richard C. Hill of the University of Maine at Orono and assigned to the Board of Trustees of the University of Maine. According to the system developed by Professor Hill and described in the patent application Ser. No. 75,815, burning of wood fuel for heating purposes is accomplished first by combustion of wood in a high temperature, e.g. 1200° F.-2000° F. (650° C.-1100° C.) refractory environment; second by delayed propagation of the flue gases in a continuing high temperature refractory insulating environment to assure complete combustion; and third only after completion of combustion, by extraction of heat from the end products of such combustion. This is accomplished by providing a substantially vertical feed primary combustion chamber having a refractory base portion forming the locus of combustion and a water jacket or water environment around the upper portion. Flue gases are drafted away from the base of the combustion chamber. The base draft and water jacket combine to confine the locus of combustion to the base of the chamber.

A flue gas delay propagation channel coupled to the draft outlet at the base of the combustion chamber is lined with refractory material and affords delayed propagation in a high temperature environment sufficient to insure substantially complete burning of the products of primary combustion. A heat exchanger coupled to the output of the flue gas delay channel receives the hot gaseous end products of combustion and transfers heat from the gases to water or other fluid medium.

Actively induced draft in addition to natural draft may be provided. In addition to actively inducing the draft, air may be forced under pressure into the combustion chamber base portion to effect turbulent mixing of air and combustion gases. A turbulent mixture therefore follows the draft from the base of the combustion chamber through the flue gas delay channel where the travel time in a high temperature environment permits substantially complete secondary burning of the flue gases prior to heat exchange.

The water jacket arrangement is a coacting element of the water system cooperating with the heat exchanger downstream. However the primary purpose of the water jacket arrangement is for confinement of combustion and controlled burning in the primary combustion chamber. As disclosed in Ser. No. 75,815, the water jacket and heat exchanger therefore comprise separate elements of the boiler system requiring separate additional space.

An improvement upon this basic Hill invention is described in U.S. Pat. No. 4,366,805 filed Apr. 24, 1981 and entitled "Sector Controlled Wood-Type Fuel Burning Furnace". This patent application describes a furnace system incorporating the features of the basic invention but which permits controlled combustion of selected sectors or segments of the wood-type fuels or other solid fuels for a high turn down ratio. The primary combustion chamber comprises a refractory base portion for high temperature combustion and an upper portion with a water jacket for quenching combustion in the upper portions of the fuel. In a preferred form the invention is embodied in a generally cylindrical or radial configuration with a plurality of refractory material secondary burning delay channels leading radially away from the refractory base portion of the primary combustion chamber. The secondary channels conduct flue gases from different sectors of the fuel to separate heat exchange pipes or fire tubes passing through the cylindrical water jacket. Separate dampers are provided for separately controlling the draft through respective radially directed secondary channels and corresponding heat exchange tubes. This permits separate control over combustion of different sectors of the fuel. The rate of combustion and heat output of the furnace may be varied and controlled without sacrificing the efficiency, completeness, and intensity of combustion. The radial configuration also affords a compact geometry in which the water jacket and heat exchange elements occupy substantially the same space.

The primary objective of this sector control improvement however, is to afford a high turn down ratio, and this is accomplished by including a duplication of elements around the furnace for separate control of combustion of the fuel in small sectors at a time.

OBJECTS OF THE INVENTION

It is therefore an object of the present invention to provide an improved wood fired or other solid fuel fired boiler or hot water heater with even greater economy of configuration and compact geometry suitable for domestic use.

Another object of the invention is to provide a small compact wood fired or solid fuel fired hot water heater suitable for the primary purpose or single purpose of heating water for domestic use.

A further object of the invention is to provide a small highly efficient and compact solid fuel hot water heater with a heat output for example in the range of 10,000 to 20,000 BTU's.

A feature and advantage of the invention is to provide a domestic hot water heater which may be used at locations in the home otherwise inaccessible by conventional wood fired heating systems.

SUMMARY OF THE INVENTION

In order to accomplish these results the present invention provides a solid fuel hot water heater comprising a primary combustion chamber with a refractory material base portion having walls and a draft outlet. The base portion forms the locus of solid fuel combustion. A water jacket defines an upright portion over the refractory material base portion for receiving a charge of solid fuel in a generally vertical stack. The water jacket may be coupled to a source of water for at least convection circulation for confining the locus of solid fuel combustion to the base of the chamber.

According to the invention heat exchange channels or pathways are defined around the outer periphery of the water jacket in heat exchange relationship with the water jacket for transfer of heat from the end products of combustion to the circulating water.

Furthermore, a flue gas delay channel arrangement extends from the draft outlet of the combustion chamber base portion to the heat exchange pathways. The delay channel pathways are defined by refractory material providing delayed propagation of the gaseous products of primary combustion in a high temperature environment sufficient to afford substantially complete secondary burning of these gaseous products. A draft may be coupled through the combustion chamber, delay channel and heat exchange pathways using either a natural chimney draft or an actively induced draft. The combustion chamber is also constructed with appropriate inlets for admitting air into the locus of primary combustion.

According to a preferred form of the invention the flue gas delay channel coupled with the combustion chamber base draft outlet defines pathways around the outer periphery of the walls of the refractory material base portion. Thus the flue gas delay channel provides pathways coaxially around the walls of the base portion of the primary combustion chamber. Similarly, the heat exchange pathways are formed coaxially around the water jacket. An opening is formed between the flue gas delay channel pathways and the heat exchange channel pathways on the side of the primary combustion chamber opposite the draft outlet from the base of the primary combustion chamber. Flue gases therefore travel in one direction around the peripheral sides of the walls of the combustion base portion for completion of combustion in a high temperature environment. The end products of combustion then pass into the heat exchange panel pathways for travel in the opposite direction around the peripheral sides of the water jacket for heat exchange to water circulating in the water jacket.

A feature and advantage of this arrangement is that the wood fired combustion system of the type invented by Professor Hill may be arranged in an extremely compact configuration and efficient space geometry for optimum completion of combustion and heat exchange in a minimum amount of space.

In the preferred embodiment the water jacket is of cylindrical configuration and the heat exchange channel or pathway is formed concentrically around the water jacket. The heat exchange channel is coupled to the flue gas delay channel through an arc shaped opening between the two.

The combustion chamber base portion walls may also be in a cylindrical configuration with the flue gas delay channel formed concentrically around the walls of the base portion. In a preferred form however, the base portion walls comprise a "U" shaped or arcuate wall portion open on one side for drafting flue gases away from the locus of combustion. The delay channel is defined by an outer wall of refractory material formed around the "U" shaped or arcuate wall portion, and an inner wall formed by the outer periphery of the "U" shaped or arcuate wall portion.

A blower may be provided for either forcing air into the locus of combustion; actively inducing a draft through the combustion chamber delay channel and heat exchange means; or for accomplishing both forced air blowing and active draft inducing.

According to another embodiment of the invention the hot water unit comprises an elongate upright column wall of refractory material. The wall is formed coaxially or concentrically around and spaced from the water jacket thereby defining an annular space between the outer periphery of the water jacket and the upright wall. Vertical baffles may be interposed in the annular space between the water jacket and upright wall for diverting the hot end products of secondary combustion over the peripheral surface of the water jacket. Thus the baffles may be positioned vertically to direct flue gas up one side of the outer periphery of the water jacket, around the water jacket and down the other side to a draft outlet formed in the upright wall.

By this arrangement the invention achieves a compact configuration for a wood fired combustion system in which the primary combustion chamber forms a central core with a lower refractory base portion and an upper water jacket portion. The secondary delay channel is formed coaxially or concentrically around the refractory base portion while the heat exchange channel or pathway is formed coaxially or concentrically around the upper water jacket portion. All of the elements of the original basic Hill invention for efficient wood fuel or solid fuel combustion are therefore confined to a minimum geometry or minimum space. Furthermore by this arrangement the water jacket serves dual functions. It quenches combustion of the upper portion of wood fuel or other solid fuel resting in a vertical stack in the primary combustion chamber at the inside of the water jacket. It also performs the heat exchange function in extracting heat from the end products of secondary burning at the outside of the water jacket.

The refractory high temperature insulating environment elements of the wood burning system remain at the lower level while the heat transfer water environment elements of the system remain at the upper level. Water may be circulated through the water environment upper level by a pump for more rapid and efficient heat transfer.

A small and compact wood fuel fired boiler or water heater is therefore provided for domestic use and in a small or confined space.

DESCRIPTION OF THE PREFERRED EXAMPLE EMBODIMENTS AND BEST MODE OF THE INVENTION

Figure 1:
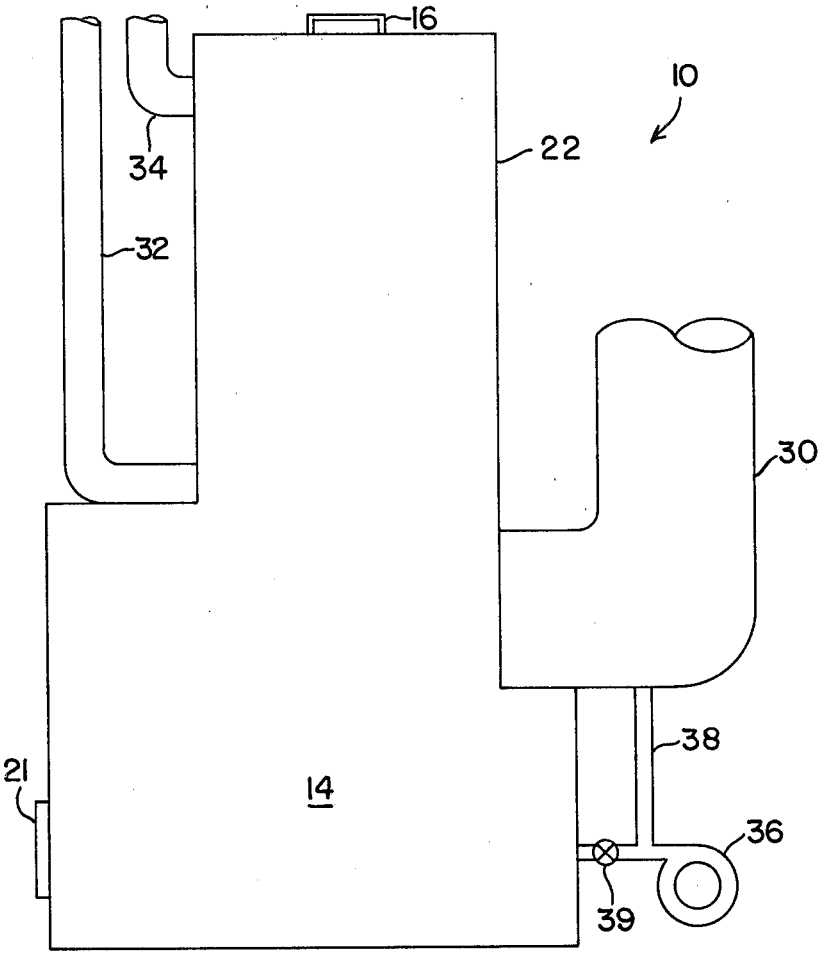
FIG. 1 is a front view of a small scale wood fuel fired hot water heater according to the present invention.
Figure 2:
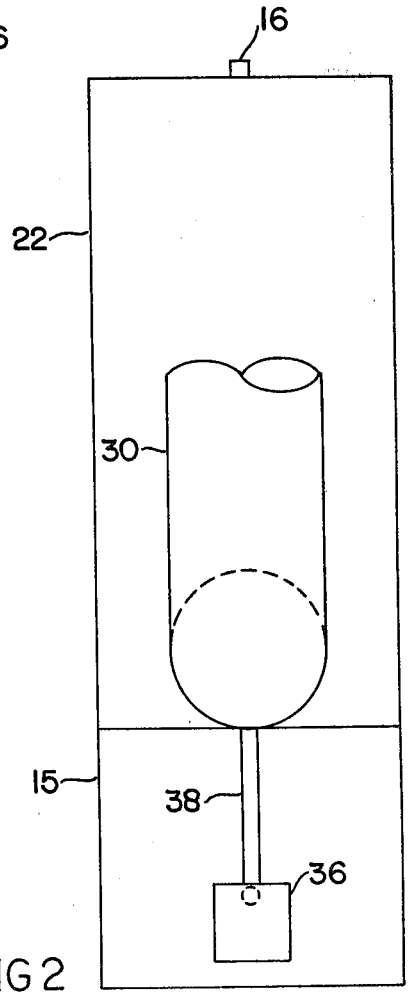
FIG. 2 is a side view and FIG. 3 a plan view from above of the hot water heater illustrated in FIG. 1.
Figure 3:
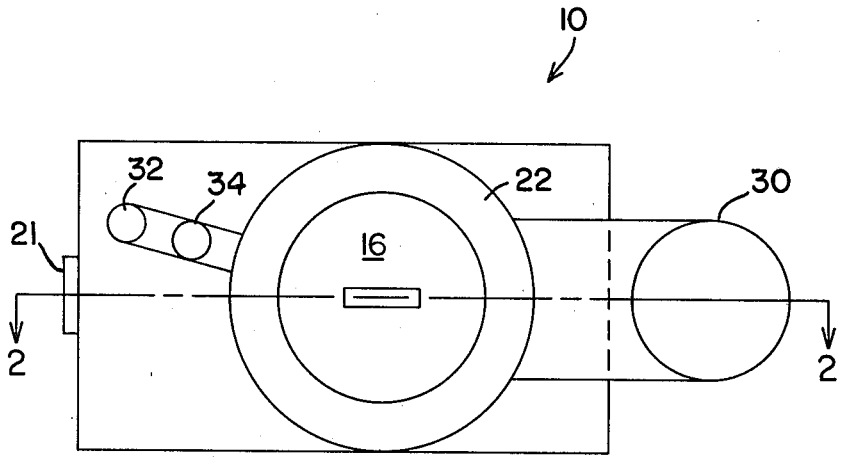
Figure 4:
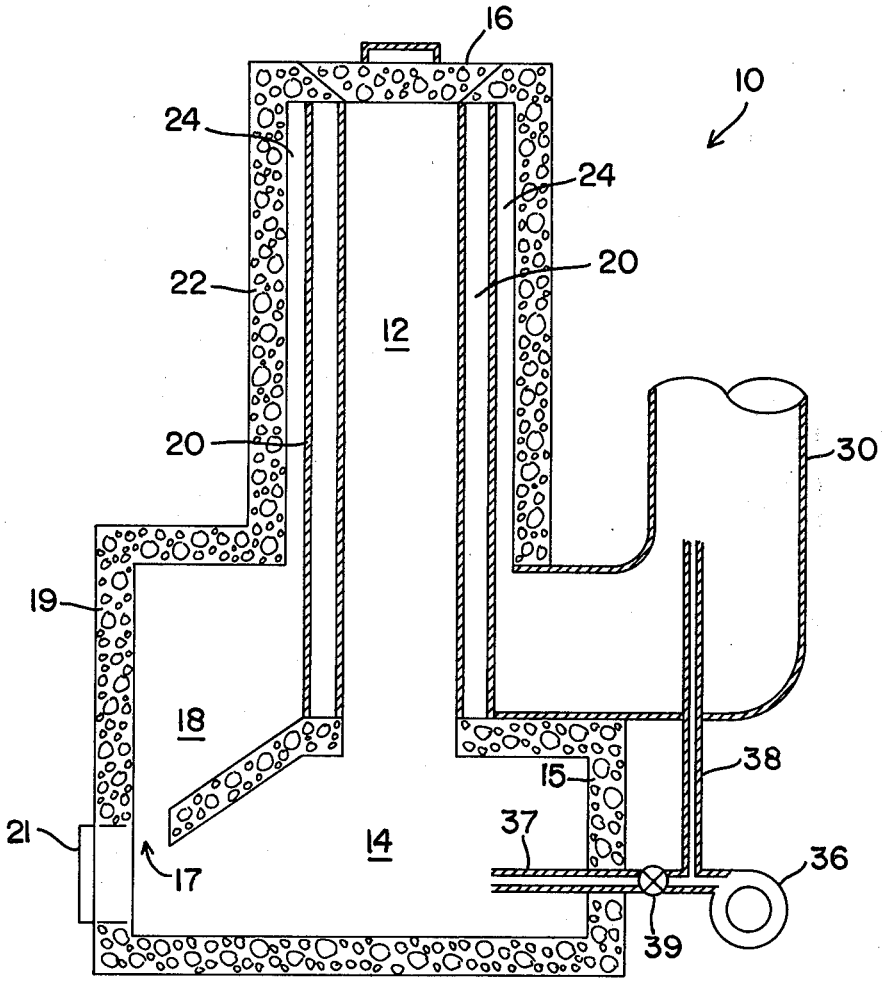
FIG. 4 is a front cross sectional view of the hot water heater illustrated in FIG. 1.

In the wood fuel fired hot water heater system according to the present invention illustrated in FIGS. 1–4 sticks of wood are loaded in a vertical array within the primary combustion chamber 12. The locus of combustion however is confined to the base portion 14 which is lined with refractory material 15 including the walls and floor. A charge of wood fuel is placed within the chamber 12 through the substantially air tight cover 16. Combustion of stick wood fuel or other solid fuel in the upright column portion of the chamber 12 within the water jacket 20 is quenched by the lower temperature maintained by water circulating through the water jacket.

Primary combustion takes place in the refractory base portion 14 at temperatures, for example in the range of 1200° F. to 2000° F. (650° C. to 1100° C.) and the gaseous products of primary combustion pass through the refractory lined delay channel or flame retention zone 18 also lined with the refractory material 19. The delay channel or flame retention zone 18 delays propagation in the high temperature environment sufficient to afford substantially complete combustion of the gaseous flue products. The delay channel culminates in a plenum which distributes the end products of combustion over one side of the outer periphery of the water jacket 20.

The water jacket 20 is made with inner and outer walls of metal for efficient heat transfer and heat exchange both inside and outside the water jacket. The combustion unit or furnace 10 is formed with an upright wall 22 of refractory material formed coaxially or concentrically around the water jacket 20 and spaced from the water jacket to define an annular space 24. The hot end products of secondary burning therefore enter the annular space 24 from the delay channel zone 18 and plenum. Vertical baffles not visible in the view of FIG. 4 prevent "short circuiting" of the flue gas around to the chimney outlet 30. Thus the baffles constrain and confine the flow of flue gas to follow a path up one side of the outer periphery of water jacket 20 in the annular space 24, then around the water jacket outer periphery, and finally down the other side of the annular space 24 to the chimney outlet or heat exchange pathway outlet 30.

Water circulating in water jacket 20 is coupled to a source of water or storage tank through inlet 32 and outlet 34. In this arrangement convection circulation or thermosiphon circulation of water from the water jacket to the storage tank and back may be sufficient to provide the desired turnover of water. A water pump may also be provided for faster throughput and circulation of water.

A blower 36 is provided performing the dual function of injecting forced air into the locus of wood fuel combustion through forced air inlet 37 and for inducing a draft in the heat exchange pathway or chimney outlet 30 through induced draft pipe 38. During fuel loading operations when the cover 16 is removed the valve 39 can be adjusted to block the flow of forced air through forced air inlet 37 at the base portion 14 of the combustion chamber. Back draft through the open cover 16 is therefore avoided and air instead rushes in through the opening as a result of the induced draft in the draft outlet 30.

The combustion chamber base portion 14 includes walls 15 and flue gas outlet 17 leading to the secondary burning delay channel and flame retention zone 18. In the construction of the furnace, the refractory material lining the walls 15 and floor of the combustion base portion, the flame retention zone walls 19 and upright walls 22 around the water jacket may be constructed of a refractory cement, for example of the type description in U.S. patent application Ser. No. 75,815 referred to above. Fire brick may also be used. An ash clean out door 21 is provided at the base of the combustion chamber at a convenient location.

Figure 5:
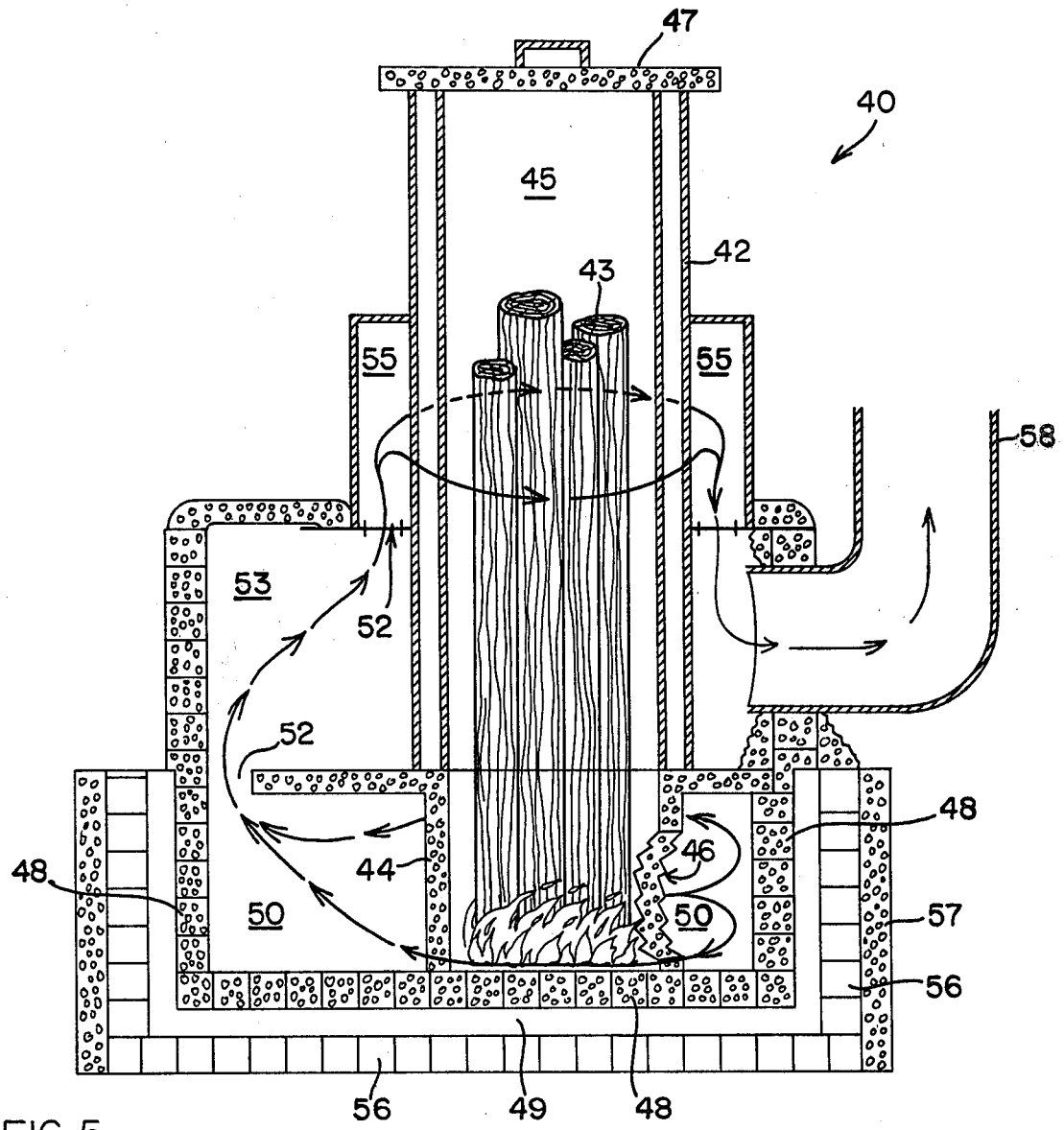
FIG. 5 is a cross sectional view of another wood fired small scale hot water boiler or heater in a configuration according to the present invention.

A more detailed example embodiment of the present invention is shown in cross section in FIG. 5. In this example embodiment the wood fuel combustion system 40 for heating hot water includes a cylindrical elongate water jacket 42 resting on a similarly cylindrical refractory cement base portion 44. Stick wood fuel 43 in a generally vertical attitude or orientation stands inside the primary combustion chamber 45 with the locus of wood fuel combustion confined to the base of the fuel and the refractory base 44 of the combustion chamber as heretofore described. An opening 46 is formed at one side of the cylindrical wall of the base 44 of the combustion chamber so that flue gases may exit through the outlet 46 and pass in either direction around the periphery of the walls of the cylindrical base 44 of the combustion chamber. An outer wall of insulating refractory blocks 48 form an enclosure around the base 44 of the combustion chamber and are spaced from the base to define the delay channel pathways 50 around the periphery of the base walls. Thus, in this example the refractory delay channel or flame retention zone 50 comprises pathways formed coaxially or concentrically around the cylindrical base walls 44 of the primary combustion chamber. The delay channel pathways afford sufficient time in the high temperature environment to assure substantially complete combustion. The end products of combustion then pass upward through openings 52 and space 53 into a heat exchange channel or zone comprising pathways 55 formed coaxially or concentrically around the water jacket 42. The space 53 does not extend around the water jacket. During passage through the heat exchange pathways 55 peripherally around the water jacket, the hot gases are in heat exchange relationship with water circulating within the metal walls of water jacket 42.

After heat transfer from the hot gaseous end products of combustion the flue products pass out through the chimney outlet 58. As in the example of FIG. 4 a blower can be provided to inject forced air into the locus of combustion in combustion chamber base 44 and also for injecting forced air into the heat exchange draft outlet 58 for inducing a draft through the elements of the furnace.

In construction of the furnace a number of layers of material may be used around the base portion including the insulating refractory bricks or fire bricks, further insulation 49, and structural bricks or cement blocks 56. An outer covering of cement 57 may also be provided.

Figure 6:
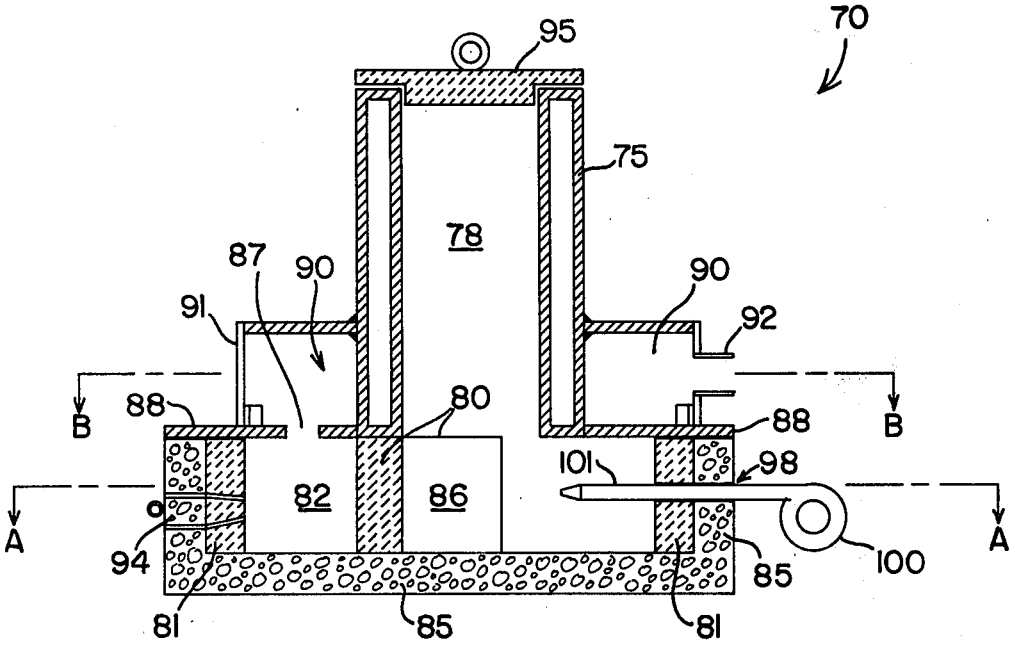
FIG. 6 is a cross sectional view of yet another hot water heater embodiment of the present invention.
Figure 6A:
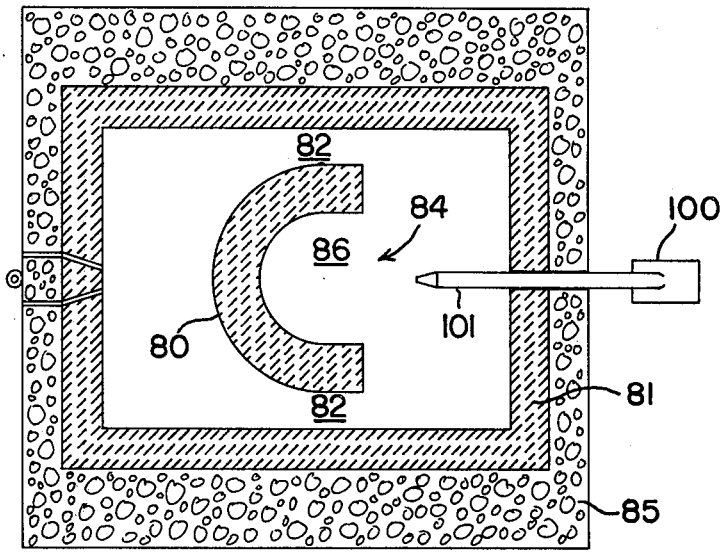
FIG. 6A is a cross sectional view from above in the direction of the arrows on line A—A of FIG. 6.
Figure 6B:
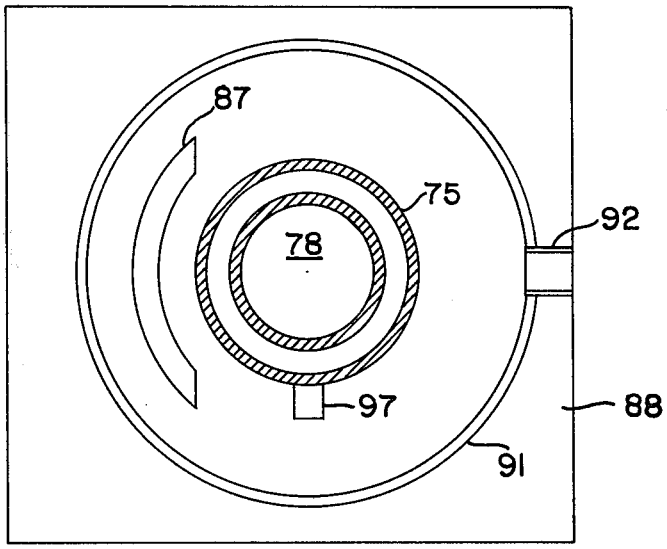
FIG. 6B is another cross sectional view from above in the direction of the arrows on line B—B of FIG. 6.

In the preferred example embodiment of the present invention illustrated in FIGS. 6, 6A and 6B, the wood-fired hot water heater 70 is provided with a cylindrical water jacket 75 resting on a refractory base portion including the "U" shaped or arcuate wall portion or element 80 constructed of refractory cement. Water jacket 75 and base element 80 together define the primary combustion chamber 78. The refractory material enclosure 81 formed around the "U" shaped refractory base element 80 defines in combination with the element 80 the flue gas delay channels 82 also referred to as flame retention zones. The enclosure walls 81 are made for example of fire brick. The flue gas delay channels or pathways 82 therefore pass around the outer periphery of the base element 80 from the open side 84 of the "U" shaped walls.

It is thus apparent that the flue gas delay channel pathways 82 are formed coaxially around the combustion chamber base 80 and locus of combustion 86 centered in the bottom of the furnace or combustion unit.

On the side of the combustion chamber 78 opposite the opening 84 in the chamber base 80 an arc shaped opening 87 is provided in separating plate 88 for coupling the delay channel pathways 82 to the heat exchange pathways 90 and for passage of the substantially complete end products of secondary burning into the heat exchange pathways 90. Heat exchange pathways 90 are formed concentrically around the water jacket 75 by a plate or skirt 91 formed concentrically around the water jacket 75 and spaced from the jacket to form the annular space of the pathways 90. The heat exchange pathways 90 terminate in the draft outlet or draft coupling 92 on the side of the combustion chamber 78 opposite the opening 87.

Flue gas products from primary combustion in chamber base 86 pass out through the open side 84 of the "U" shaped base and through the delay channels 82 around the outer peripheral sides of element 80 in one direction. The end products of combustion then pass through opening 87 into the heat exchange pathways 90 around the outer peripheral sides of heat exchanger 75 in the opposite direction. As a result, the lengthy overall path is compressed into a minimum space while achieving the results of efficient complete combustion and heat transfer.

In construction of the hot water heater combustion unit of FIG. 6 the entire bottom portion of the unit may be placed in masonry floor and frame 85 with an ash clean out door 94 leading into the base of the primary combustion chamber 78. A substantially air tight cover 95 is provided for loading wood in the form of vertically arrayed sticks or in the form of pieces of wood or other solid fuel in a substantially vertical stack. Water connections 97 provide inlet and outlet for circulating water through the water jacket 75 for convection or pump driven circulation of the water. An opening 98 is also provided in the wall of the bottom framework of the unit for admitting air into the locus of combustion. A blower 100 and forced air inlet 101 may also be provided for delivering under pressure into the locus of combustion for turbulent mixing of air and gaseous products of combustion.

Both forced air and actively induced draft may be effected by a single fan or two fans. In either event a high limit switch may be used to shut off the fans at a specified high temperature. A thermostat in the chimney or stack may be used to shut down the system at low stack temperature.

An additional feature of construction is that the plate or skirt 91 may be in the form of a "wrap around skirt" easily removed from around the combustion chamber for cleaning and removing dust from the heat exchanger.

The water jacket inlet and outlet connections may be piped to an elevated low pressure tank for example a 100 gallon tank vented to the atmosphere through an open expansion tank. An extended surface heat transfer coil may be installed in the 100 gallon tank for heat transfer to the domestic supply.

Typical dimensions for a furnace as illustrated in FIGS. 5 or 6 in order to achieve a heat output of for example 10,000 to 20,000 BTU/hr. may be as follows. The water jacket would have an overall height of 2½ to 3 feet (75–100 cm), inner diameter of approximately 8" (20 cm), outer diameter of 10"–11" (25–28 cm), resting on a cast refractory base of the same diameter and a height of, for example 9" (23 cm). The flue gas delay channels extend around the periphery of the combustion chamber base portion wall with approximately the same height. The height of the heat exchange pathways formed concentrically around the periphery of the water jacket would have a height of for example 10" (25cm).

While the present invention has been described with reference to the combustion of sticks of wood, it is also apparent that the invention is applicable to pieces of wood or other solid wood type fuels of whatever shape or orientation arranged in a vertical stack in the primary combustion chamber for gravity feed into the locus of combustion. Furthermore, the combustion chamber may be arranged alternatively as a downdraft combustion chamber with appropriate grate. It is only essential that the draft be drawn from the base of the primary combustion chamber whether adjacent or beneath the combustion itself. Either naturally induced or actively induced draft may be used as the circumstances require, as may forced combustion air or passively admitted combustion air according to the circumstances.

While the invention has been described with reference to particular example embodiments, it will be appreciated that it is intended to cover all modifications and equivalents with the scope of the following claims.

We claim:

1. A solid fuel hot water heater comprising:

primary combustion chamber means comprising a refractory material base portion including walls and a draft outlet, said base portion forming the locus of solid fuel combustion, said refractory material base portion comprising a "U" shaped or arcuate wall portion open on one side for drafting flue gases away from the locus of combustion, and water jacket means defining an upright portion over the refractory material base portion for receiving a charge of solid fuel in a generally vertical stack, said water jacket means including coupling means for coupling to a source of water for at least convection circulation for confining the locus of solid fuel combustion to the base portion of the combustion chamber means;

flue gas delay channel means coupled with the combustion chamber base portion draft outlet, said delay channel means defining pathways around the outer periphery of the walls of the refractory material base portion, said delay channel means defined by refractory material and providing delayed propagation in a high temperature environment sufficient to afford substantially complete secondary burning of the gaseous products of combustion;

heat exchange channel means defining pathways around the outer periphery of the water jacket means in heat exchange relationship with said water jacket means for transfer of heat from the end products of combustion to the circulating water, said heat exchange channel means coupled to said flue gas delay channel means;

means for coupling a draft through the combustion chamber means, delay channel means and heat exchange means including draft outlet means from said heat exchange channel means;

and means for admitting combustion air into said combustion chamber means.

2. The hot water heater of claim 1 wherein said flue gas delay channel means is formed coaxially around the walls of the base portion of the primary combustion chamber, and wherein the heat exchange means is formed coaxially around the water jacket means, said flue gas delay channel means coupled to the heat exchange channel means through an opening formed there between on the side of the primary combustion chamber opposite the base portion draft outlet whereby the flue gases travel in one direction around the periphery of the walls of the combustion chamber base portion through said delay channel means for completion of combustion in a high temperature environment and whereby the end products of combustion pass in the opposite direction around the periphery of the water jacket means for heat exchange to water circulating in said water jacket means.

3. The hot water heater of claim 1 wherein said water jacket means is of cylindrical configuration and wherein said heat exchange channel means is formed concentrically around said water jacket means, said heat exchange channel means coupled to the delay channel means through an opening formed there between on the side of the combustion chamber means opposite the base portion draft outlet.

4. The hot water heater of claim 1 wherein said "U" shaped or arcuate wall portion open on one side for drafting flue gases away from the locus of combustion comprises an arcuate cylindrical wall portion open at one side.

5. The hot water heater of claim 1 wherein said delay channel means is defined by outer wall means of refractory material formed around the "U" shaped or arcuate wall portion, and inner wall means formed by the outer periphery of said "U" shaped or arcuate wall portion.

6. The hot water heater of claim 1 further comprising lower means and inlet means operatively arranged for forcing air into the combustion chamber base portion.

7. The hot water heater of claim 1 wherein said means for inducing a draft comprises active draft inducing means for establishing a pressure gradient through the combustion chamber means, delay channel means and heat exchange means in excess of natural chimney induced draft.

8. The hot water heater of claim 1 further comprising blower means coupled to the base portion of the combustion chamber means for introducing air under pressure into the locus of combustion and further coupled to the heat exchange channel means draft outlet means for actively inducing a draft from said outlet means.

9. The hot water heater of claim 1 wherein the upright portion of the primary combustion chamber is formed with a substantially air tight cover.

10. A solid fuel hot water heater comprising:

primary combustion chamber means comprising a refractory material base portion having walls and a draft outlet, said base portion forming the locus of solid fuel combustion, and water jacket means defining an upright portion over the refractory material base portion for receiving a charge of solid fuel in a generally vertical stack, said water jacket means including coupling means for coupling to a source of water for at least convection circulation for confining the locus of solid fuel combustion to the base portion of the combustion chamber means;

heat exchange channel means defining pathways around the outer periphery of the water jacket means in heat exchange relationship with said water jacket means for transfer of heat from the end products of combustion to the circulating water;

flue gas delay channel means extending from the combustion chamber base portion draft outlet to said heat exchange channel means, said delay channel means defined by refractory material and providing delayed propagation of the gaseous products of solid fuel combustion in a high temperature environment sufficient to afford substantially complete secondary burning of the gaseous products of combustion;

means for coupling a draft through the combustion chamber means, delay channel means and heat exchange means including draft outlet means from said heat exchange channel means;

means for admitting air into said combustion chamber means;

said refractory material base portion comprising an arcuate cylindrical wall portion configuration open at one side to provide the draft outlet, said delay channel means being defined between outer wall means of refractory material formed around the arcuate cylindrical wall portion and inner wall means comprising said arcuate cylindrical wall portion configuration of the refractory material base portion.

11. The solid fuel hot water heater of claim 10 wherein said water jacket means comprises an elongate upright column and wherein said heat exchange channel means comprises upright wall means of refractory material formed coaxially around and spaced from the water jacket means thereby defining an annular space between the outer periphery of the water jacket means and the upright wall means.

12. The solid fuel hot water heater of claim 11 further comprising baffle means interposed in the annular space between the water jacket means and upright wall means said baffle means positioned to direct flue gas up one side of the outer periphery of water jacket, around the water jacket means, and then down the other side of said water jacket means, said means for coupling a draft comprising draft outlet means formed in the upright wall means.

13. The solid fuel hot water heater of claim 11 wherein said water jacket means is of cylindrical configuration and wherein said heat exchange channel means is formed concentrically around said water jacket means.

14. The hot water heater of claim 10 further comprising active blower means operatively coupled for blowing air under pressure into the primary combustion chamber base portion.

15. The hot water heater of claim 14 wherein said active blower means is also operatively coupled for inducing a draft from the draft outlet means of said heat exchange channel means.

16. The hot water heater of claim 10 wherein said flue gas delay channel means comprises plenum means for distributing the end products of combustion over one side of the water jacket means.

17. A compact solid fuel hot water heater suitable domestic scale use comprising:

primary combustion chamber means forming an upright column including a refractory material base portion formed with "U" shaped arcuate opening at one side to provide a flue gas outlet, and an upper water jacket portion defining fuel enclosure means over the base portion;

flue gas delay channel means formed coaxially around the walls of the combustion chamber base portion and coupled to the flue gas outlet said delay channel means defined by refractory material and arranged for conducting flue gas around the outer periphery of the walls of the base portion for delayed propagation in a refractory high temperature environment sufficient to afford substantially complete secondary burning of the gaseous products of combustion;

heat exchange pathway means formed coaxially around the outer periphery of the water jacket portion in heat exchange relationship with said water jacket portion, said heat exchange pathway means coupled to the delay channel means through opening means formed there between on the side of the combustion chamber means opposite the base portion flue gas outlet, said heat exchange pathway means formed with draft outlet means on the side of the combustion chamber means opposite said opening means.

18. The compact hot water heater of claim 17 wherein said upper water jacket portion is of cylindrical configuration, said heat exchange pathway means comprising an annular space formed concentrically around said water jacket means.

19. The compact hot water heater of claim 18 wherein said annular space is formed concentrically around said water jacket means by wrap-around skirt means, said wrap around skirt means being operatively removeable and replaceable for cleaning out the heat exchange pathway means.

20. The compact hot water heater of claim 17 wherein the flue gas delay channel means is defined between outer wall means of refractory material formed around the "U" shaped arcuate walls, and inner wall means comprising said "U" shaped arcuate walls of the refractory material base portion.

* * * * *